US008181274B1

(12) United States Patent
Prince et al.

(10) Patent No.: US 8,181,274 B1
(45) Date of Patent: May 22, 2012

(54) NOVELTY SHIRT

(76) Inventors: Prairie Prince, San Francisco, CA (US); Ross Lamont Valory, Danville, CA (US)

( * ) Notice: Subject to any disclaimer, the term of this patent is extended or adjusted under 35 U.S.C. 154(b) by 1019 days.

(21) Appl. No.: 12/150,225

(22) Filed: Apr. 24, 2008

Related U.S. Application Data

(60) Provisional application No. 60/914,249, filed on Apr. 26, 2007.

(51) Int. Cl.
*A41B 1/00* (2006.01)
*A41D 27/00* (2006.01)

(52) U.S. Cl. ..... 2/115; 2/244

(58) Field of Classification Search ..... 2/244, 115, 2/113, 77, 75, 80, 239; 446/149; 283/94, 283/98, 99, 100, 63.1
See application file for complete search history.

(56) References Cited

U.S. PATENT DOCUMENTS 1,244,065 A * 10/1917 Miller ..... 116/35 R
1,614,923 A * 1/1927 Honti ..... 446/149
2,259,205 A * 10/1941 Heilpern ..... 446/149
2,420,986 A * 5/1947 Smith ..... 446/149
4,253,197 A * 3/1981 Posta ..... 2/69
4,296,498 A * 10/1981 Vinson ..... 2/115
4,365,353 A * 12/1982 Rayl ..... 2/115
4,710,981 A * 12/1987 Sanchez ..... 2/115
4,847,916 A * 7/1989 Winston ..... 2/113
4,980,929 A * 1/1991 Long ..... 2/125
4,991,233 A * 2/1991 Hall ..... 2/115
4,999,848 A * 3/1991 Oney ..... 2/115
5,084,915 A * 2/1992 Shotwelkl et al. ..... 2/115
5,117,507 A * 6/1992 Long ..... 2/158
5,275,818 A * 1/1994 Kind ..... 434/157
5,368,518 A * 11/1994 Hitchcock ..... 446/329
5,379,461 A * 1/1995 Wilmers ..... 2/115
5,394,565 A * 3/1995 Stewart et al. ..... 2/69
5,516,321 A * 5/1996 Kornbleuth ..... 446/28
5,586,888 A * 12/1996 Webb ..... 434/258
5,762,335 A * 6/1998 Magruder ..... 273/153 R
5,815,837 A * 10/1998 Christman et al. ..... 2/158
5,845,334 A * 12/1998 Marcolini, Jr. ..... 2/69
5,943,697 A * 8/1999 Poskanzer ..... 2/69
5,943,698 A * 8/1999 Blanks, I ..... 2/69
5,953,757 A * 9/1999 Blanks, I ..... 2/243.1
5,960,476 A * 10/1999 Danzy ..... 2/115
6,076,189 A * 6/2000 Christman et al. ..... 2/158
6,175,960 B1 * 1/2001 Knittel ..... 2/115
6,314,581 B1 * 11/2001 Bond ..... 2/129
6,397,390 B1 * 6/2002 Henderson et al. ..... 2/69
6,405,381 B1 * 6/2002 Bowman, Jr. ..... 2/170
6,550,066 B1 * 4/2003 Brassey ..... 2/93
6,782,554 B1 * 8/2004 Froehlich ..... 2/69
7,310,830 B2 * 12/2007 Kuharcik et al. ..... 2/246

(Continued)

*Primary Examiner* — Alissa L Hoey
(74) *Attorney, Agent, or Firm* — Risto A. Rinne, Jr.

(57) ABSTRACT

A novelty shirt with a chest section and long sleeves. The long sleeves in a first position extend downwardly adjacent the sides of the shirt and have shoulder and cuff portions spaced from each other along the vertical axes with elbow portions therebetween. Upper and lower, complementary mouth patterns are then provided on the outsides of the sleeves. The patterns on the downwardly extending sleeves face outwardly and it is not readily apparent that they are part of any overall design. However, when the sleeves are crossed laterally in front of the chest section of the shirt with the elbow portions adjacent one another, the complementary upper and lower mouth patterns on the sleeves then reveal the overall mouth design formed by them. Thereafter, the sleeves can be manipulated to separate the elbow portions to simulate the opening of the mouth.

11 Claims, 7 Drawing Sheets

U.S. PATENT DOCUMENTS

| | | | | |
|---|---|---|---|---|
| D575,029 | S * | 8/2008 | Bengyak | D2/844 |
| D575,030 | S * | 8/2008 | Bengyak | D2/844 |
| D575,031 | S * | 8/2008 | Bengyak | D2/858 |
| D575,479 | S * | 8/2008 | Bengyak | D2/858 |
| D575,932 | S * | 9/2008 | Bengyak | D2/840 |
| 7,434,271 | B2 * | 10/2008 | Klayman-Grodsky | 2/244 |
| D588,340 | S * | 3/2009 | Bengyak | D2/858 |
| 7,725,955 | B1 * | 6/2010 | Johnson | 2/115 |
| D628,361 | S * | 12/2010 | Bengyak | D2/840 |
| D628,767 | S * | 12/2010 | Bengyak | D2/619 |
| D628,773 | S * | 12/2010 | Bengyak | D2/840 |
| 2002/0020082 | A1 * | 2/2002 | James | 36/112 |
| 2002/0152532 | A1 * | 10/2002 | Hardy | 2/69 |
| 2003/0084498 | A1 * | 5/2003 | Egnew | 2/94 |
| 2004/0068778 | A1 * | 4/2004 | Van Veghel et al. | 2/244 |
| 2005/0278821 | A1 * | 12/2005 | Klayman-Grodsky | 2/69 |
| 2005/0278825 | A1 * | 12/2005 | Altman | 2/115 |
| 2006/0143779 | A1 * | 7/2006 | Lee | 2/115 |
| 2006/0179550 | A1 * | 8/2006 | Fleming | 2/244 |
| 2007/0118962 | A1 * | 5/2007 | Orr | 2/115 |
| 2007/0220652 | A1 * | 9/2007 | Kuharcik et al. | 2/115 |
| 2007/0250982 | A1 * | 11/2007 | Norman | 2/69 |
| 2008/0052803 | A1 * | 3/2008 | Kuharcik et al. | 2/115 |
| 2008/0301856 | A1 * | 12/2008 | Errigo | 2/239 |
| 2009/0056727 | A1 * | 3/2009 | Hill | 128/880 |
| 2009/0100571 | A1 * | 4/2009 | Soto | 2/125 |
| 2009/0126073 | A1 * | 5/2009 | Lovett | 2/115 |
| 2009/0271911 | A1 * | 11/2009 | McKiski | 2/159 |
| 2010/0024091 | A1 * | 2/2010 | Mehtab et al. | 2/69 |
| 2011/0099684 | A1 * | 5/2011 | Kane | 2/115 |

* cited by examiner

NOVELTY SHIRT

This application claims the benefit of priority of Provisional Patent Application Ser. No. 60/914,249 by the same inventors that was filed on Apr. 26, 2007.

BACKGROUND OF THE INVENTION

1. Field of the Invention

This invention relates to the field of novelty shirts and more particularly to the field of long sleeve novelty shirts that can be manipulated by the wearer to selectively reveal an overall design.

Clothing is worn for two primary reasons. The first is obviously to meet customary decency standards with regard to physical exposure and the second is to provide protection from environmental factors. If, however, these were the only reasons for wearing clothing there would be relatively few patterns and colors available.

It is safe to assume that for as long as man has adorned himself or herself with any type of garment, it has been observed that the wearing changes the appearance of the wearer. Even today, we recognize that Presidents dress in a certain generally accepted way to convey power and authority while laborers dress in an entirely different way. We have even learned to classify the economic status of people by the way they dress while at work, labeling some as "blue collar" and others as "white collar" workers.

Clothing projects an image. It says something about the wearer. As a result, people use clothing to express themselves in a variety of ways. They may wear something that is "fun" when they want to be playful and they may wear something that is more formal when the situation so warrants.

In addition to economic status, clothing has long been recognized as also providing an expression of the wearer's values, lifestyle, attitude, or opinions. Some articles of clothing are worn more for their expressive value than for any other reason.

This is an important economic consideration. If a garment is deemed to be expressive of anything that the wearer wishes to convey, then that wearer is generally willing to pay a premium for that garment.

T-shirts, for example, often include a written message that indicates some position or opinion of the wearer. Alternately, the T-shirt or any other type of novelty shirt may be worn because it is intended to be humorous or fun to wear.

People are often complimented or otherwise acknowledged for the clothing they wear. Many people make their clothing purchase decisions with this in mind. In other words, they want to be noticed by others and they want others to pay attention to them. They do this by encouraging others to notice and possibly comment on the way they are dressed.

In this way, people use clothing as a means to engage in conversation or interaction with others. This is done by people of all ages. However, there are few ways in which an article of clothing, such as a shirt, can draw other people in to engage socially. A bright or unusual pattern or a provocative message on the shirt have been the principle ways to attract attention and thereby engage or interact with others.

Novelty shirts with various design patterns on them are universally popular. The shirts can have designs that are revealed at all times such as a pattern on the chest as in U.S. Pat. No. 4,772,503 to Donsky. They can also have portions of an overall design on different parts of the shirt (e.g., the chest and sleeves as in U.S. Pat. Nos. 4,980,929 and 5,117,507 to Long) wherein the wearer can manipulate the shirt parts to activate or reveal the overall design. In such wearer-activated shirts, the patterning of the design and its parts on the shirt must be very cleverly done and essentially determines how popular and unique the novelty shirt will be.

Accordingly, prior art novelty shirt designs are limited as far as the degree of expression that is possible and in their ability to elicit the voluntary engagement of others to participate or interact socially.

With this and other things in mind, the present invention was developed. In it, parts of an overall design are created on the sleeves of the shirt and the overall design is only revealed when the sleeves of the novelty shirt are crossed in front of the wearer's chest.

Additional patterns relating to the overall design can also be provided on the chest section of the shirt or on a hood, if desired.

Accordingly, there exists today a need for a novelty shirt that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus would be a useful and desirable device.

2. Description of Prior Art

T-shirts are, in general, known. For example, the following patents describe various types of these devices:

U.S. Pat. No. 4,772,503 to Donskey, that issued on Sep. 20, 1988;

U.S. Pat. No. 4,980,929 to Long, that issued on Jan. 1, 1991; and

U.S. Pat. No. 5,117,507 to Long, that issued on Jun. 2, 1992.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a novelty shirt that in a first, normal or quiescent position, does not reveal an image of a mouth on the sleeves of the shirt to an observer viewing the front torso portion of a wearer.

It is also an important object of the invention to provide a novelty shirt that in a second position reveals an image of a mouth on the sleeves of the shirt to an observer viewing the front torso portion of a wearer.

Another object of the invention is to provide a novelty shirt that in a second position reveals an image of a mouth on the sleeves of the shirt to an observer viewing the front torso portion of a wearer and which includes a design on a torso area of the novelty shirt that augments the image that is produced.

Still another object of the invention is to provide a novelty shirt that in a second position reveals an image of a mouth on the sleeves of the shirt to an observer viewing the front torso portion of a wearer and which includes a hood that is adapted to extend over at least a portion of a head of the wearer and which augments the image that is produced.

Still yet another object of the invention is to provide a novelty shirt that in a second position reveals an image of a mouth on the sleeves of the shirt to an observer viewing the front torso portion of a wearer and which includes a design on a torso area of the novelty shirt that augments the image that is produced and which also includes a hood that is adapted to extend over at least a portion of a head of the wearer and which thereby further augments the image that is produced.

Yet another important object of the invention is to provide a novelty shirt that is designed to not attract attention when worn in a first position.

Still yet another important object of the invention is to provide a novelty shirt that is designed to not attract attention when worn in any position other than when the sleeves are crossed in front of the chest of a wearer in a predetermined manner.

A first continuing object of the invention is to provide a novelty shirt that encourages a response by an observer when a wearer of the novelty shirt crosses his or her arms in front of the chest of the wearer, thereby producing an image of a mouth or other body part.

A second continuing object of the invention is to provide a novelty shirt that encourages play by the wearer thereof.

A third continuing object of the invention is to provide a novelty shirt that permits a wearer thereof to manipulate the shirt in a predetermined way and thereby engage in a form of play.

A fourth continuing object of the invention is to provide a novelty shirt that, when worn by two or more people in sight of each other, promotes interaction between the people when any of the novelty shirts are manipulated in a predetermined way.

A fifth continuing object of the invention is to provide a novelty shirt that can selectively produce an alternate image of a mouth, head, or other body part.

A sixth continuing object of the invention is to provide a novelty shirt that has a first, quiescent position that does not fully or effectively reveal an alternate image and a second position that fully or effectively reveals the desired alternate image.

A seventh continuing object of the invention is to provide a novelty shirt that, when disposed in a second position, creates an effective image of a mouth or other body part such as an eye on the sleeves of the shirt, and wherein it is possible to further simulate an opening or closing of the mouth or body part by respectively separating or urging together the elbows of a wearer, thereby urging the novelty shirt into a third position.

An eighth continuing object of the invention is to provide a novelty shirt that encourages movement by the wearer and which thereby helps to promote exercise and good health.

Briefly, a novelty shirt that is constructed in accordance with the principles of the present invention includes a chest section and long sleeves. The long sleeves are attached to the chest section and in a first position, the sleeves extend downwardly along vertical axes adjacent the sides of the shirt. The sleeves have shoulder and cuff portions spaced from each other along the vertical axes with elbow portions therebetween. Upper and lower complementary mouth patterns are then provided on the outsides of the sleeves.

In the first position with the long sleeves extending downwardly at the sides of the shirt, the patterns on the sleeves face outwardly and it is not readily apparent that they are part of any overall design.

However, when the sleeves are crossed laterally in front of the chest section of the shirt with the elbow portions adjacent one another in a second position, the complementary upper and lower mouth patterns on the sleeves combine together to produce a combined image that reveals an overall mouth design (i.e., a simulated image of a mouth) that is formed by patterns on the sleeves. Thereafter, the sleeves can be manipulated to separate the elbow portions to simulate the opening and/or closing of the mouth. Additional patterns (e.g., tongues, teeth or throats, eyes, head) relating to the overall mouth design can also be provided on the sleeves and, if desired, as a primary image on the chest section of the shirt. When the novelty shirt is in the second position the primary image on the chest section combines with the simulated image of a mouth to produce an alternate overall image. If desired, an optional hood is included and can be used to augment the alternate overall image. The primary image on the chest section, if desired, can further include patterns of another body part or parts (e.g., a rib cage).

DETAILED DESCRIPTION OF THE INVENTION

Figure 1:
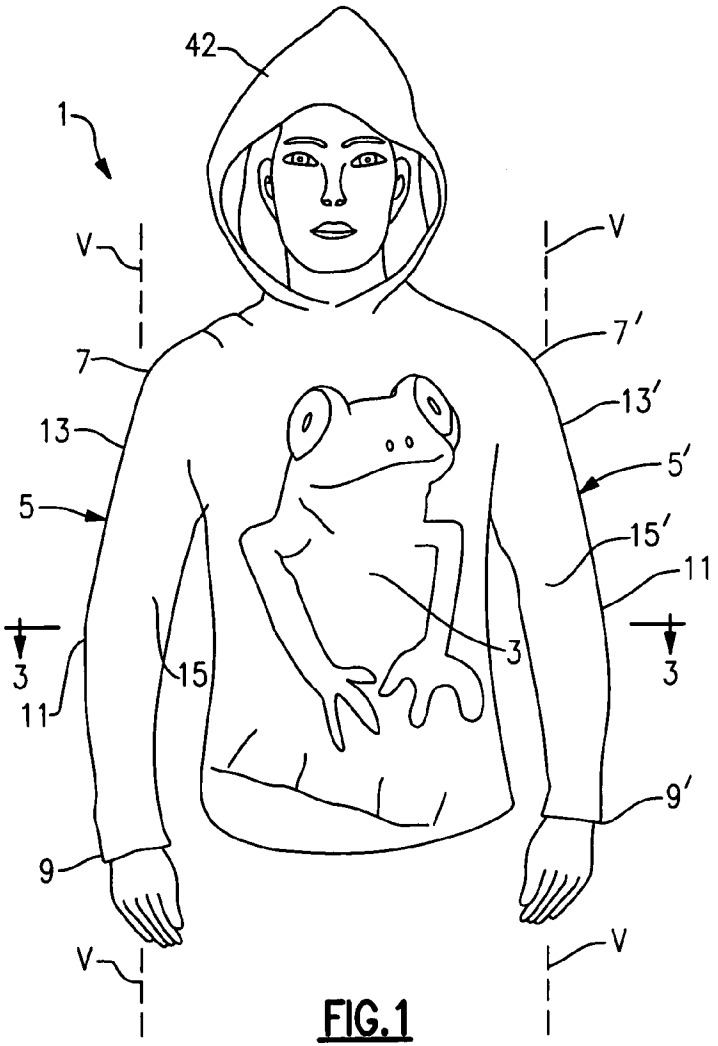
FIG. 1 is a front elevational view of the novelty shirt of the present invention with the sleeves of the shirt extending downwardly along the sides of the shirt.
Figure 2:
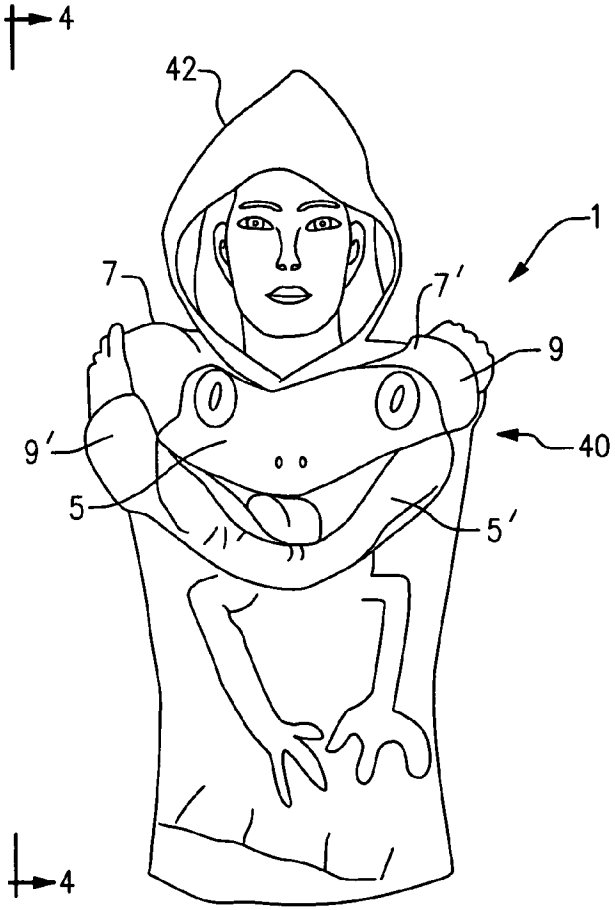
FIG. 2 is a front elevational view of the shirt of FIG. 1 with the sleeves crossed laterally in front of the chest with the upper and lower, complementary mouth patterns on the sleeves aligned to form a mouth.

FIGS. 1 and 2 illustrate a novelty shirt 1 of the present invention. As shown, the shirt 1 has a chest section 3 (FIG. 1) and two long sleeves 5,5' attached thereto. In the position of FIG. 1, each long sleeve 5,5' extends downwardly along a substantially vertical axis V adjacent a side of the chest section 3.

This position is on occasion referred to herein as a first position, or alternately as a quiescent position. As shown, each long sleeve 5,5' has a shoulder portion 7,7' and a lower, cuff portion 9,9' spaced therefrom along the vertical axis V with an elbow portion 11,11' therebetween. The cuff portion 9,9' defines a distal end of each of the long sleeves 5,5'. It is possible to include a formal visible cuff portion 9,9' at the distal ends of the sleeves 5,5' or to terminate the sleeves 5,5' at the distal end in any preferred way.

Figure 3:
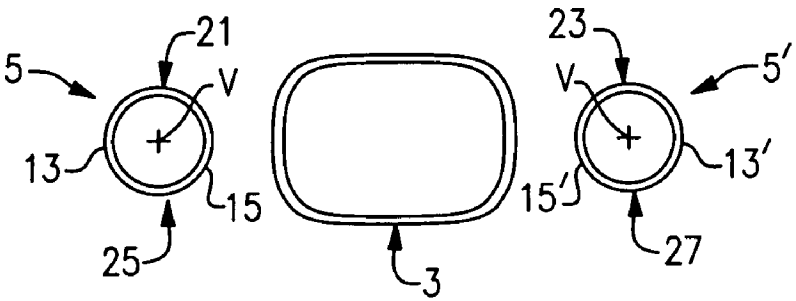
FIG. 3 is a cross-sectional view taken along line 3-3 of FIG. 1.

Each long sleeve 5,5' has an outside section 13,13' and an inside section 15,15' (see FIGS. 1 and 3). The outside sections 13,13' extend along the respective vertical axes V with the sleeves 5,5' in the position of FIG. 1. As shown, the sections 13,13' face substantially outwardly of the chest section 3 (see also FIG. 3) and the inside sections 15,15' face substantially toward the chest section 3.

The outside sections 13,13' of the long sleeves 5,5' have at least portions thereof with upper and lower, complementary mouth patterns. The mouth patterns are imprinted on the long sleeves 5, 5' as a design image. If preferred, any other complementary image or pattern, for example that of an eye or eyes, nose, teeth, hair, or head, could be included on each of the outside sections 13, 13' of the long sleeves 5,5'.

As used herein, the term "complementary mouth pattern" is intended to include any indicia (i.e., printed image) that may be desired such as whatever image detail is required to define upper and lower mouth portions as well as to possibly include an eye or eyes, nose, teeth, hair, or any desired portion or features of a head. The desired image detail will vary depending upon what type of a combined image, as is described in greater detail hereinafter, is to be provided by the novelty shirt 1. Any type of a creature, fictitious or real, can be included and the image detail will, of course, vary accordingly.

A first half or portion of the mouth pattern (or other body part pattern) is imprinted on the outside section 13 of a first one 5 of the long sleeves. A complementary second half or remaining portion of the mouth pattern is imprinted on the outside section 13' of a second one the long sleeves.

It is important to note that when the novelty shirt 1 is viewed from the front (as shown in FIG. 1) and when the long sleeves 5, 5' are disposed in the first position, the complementary mouth patterns are not substantially visible. Furthermore, when viewed from the front and when in the first position, a primary image that is visible to an observer is that which is printed on the torso (i.e., the chest section 3) of the novelty shirt 1. In the example shown the primary image includes the body and head of a frog. Of course, the use of any other image of any other creature, real or imagined, is equally possible for use as the primary image or for any other image portion of the novelty shirt 1, as is described in greater detail hereinafter. It is also noted that the inclusion of the primary image on the chest section 3 is optional and may be omitted with certain versions of the novelty shirt 1.

In normal or quiescent use, the sleeves 5,5' are in the first position. Alternately the sleeves 5,5' may be disposed in any position other than in a second position or third position (as are described in greater detail hereinafter) in order to maintain the novelty shirt 1 in the normal, quiescent state. The second and third positions are described in greater detail, hereinafter.

In the first or quiescent position, the novelty shirt 1 appears much as a prior art type of novelty shirt (not shown) having an image (i.e., a primary image) on the front thereof. If desired, a rear image could also be included on the back of the novelty shirt 1. Alternately if desired, the novelty shirt 1 may omit the primary image on the front or the rear image on the back, or both, and still function.

In the first position when the novelty shirt is viewed from either side it is noted that the complementary mouth patterns on the outside sections 13,13' of the long sleeves 5,5' provide in general a design but because they are not complete by and of themselves, do not form a simulated image of a mouth, as is discussed in greater detail hereinafter. This means that the novelty shirt 1, when viewed from the side and when disposed in the first position, appears somewhat ordinary. The complementary mouth patterns may appear more like a random pattern of designs, and thereby they would not suggest the image that they are capable of revealing when urged into the second position.

It is important to note that the novelty shirt 1, when disposed in the first position, does not form the simulated image and thereby, does not attract more than a reasonable amount of attention by observers thereof. This is important because it worn in this position (i.e, the quiescent or first position) most of the time. By not generating undo attention, the novelty shirt 1 can be worn in classrooms and other areas without contributing toward or possibly causing an undo disruption. It is important to also note that it is the wearer that determines the state of the novelty shirt 1 by the manner (i.e., by controlling the position) in which it is worn. This is substantially different than with prior art shirt designs that reveal all of their image at all times and regardless of the position that the prior art shirt is disposed in.

Figure 4:
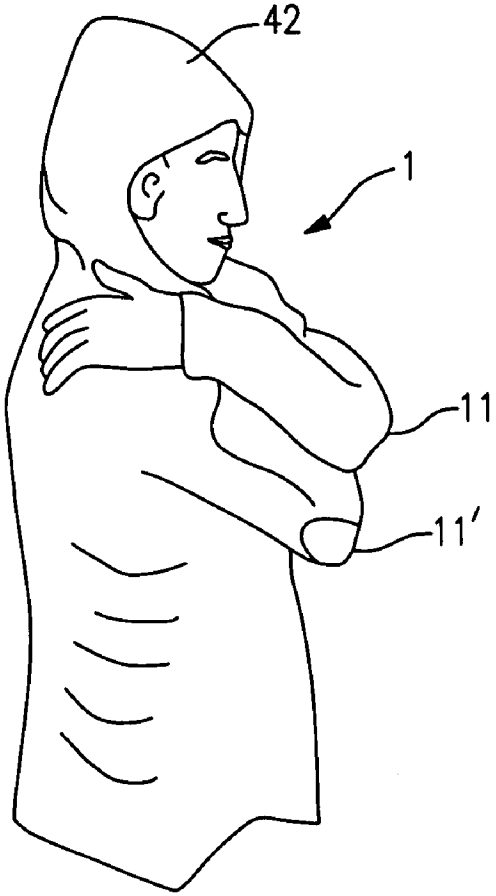
FIG. 4 is a side view taken along line 4-4 of FIG. 2.

As briefly mentioned earlier, the novelty shirt 1 can also be disposed in the second position. In the second position the long sleeves 5,5' are crossed laterally in front of the chest section 3 (as shown in FIGS. 2 and 4) of the wearer. In this position, each sleeve 5,5' extends substantially side to side (FIG. 2) across the chest section 3 with the elbow portions 11,11' substantially adjacent one another (see also FIG. 4) and generally centered around the middle of the chest section 3.

While in this position, the upper and lower mouth patterns on the outside sections 13,13' then align as in FIG. 2 to form the simulated image of a mouth. The simulated image of a mouth may include an entire image of a mouth or an image of a portion of a mouth, as desired. As is described in greater detail hereinafter, the simulated image may also reveal (i.e., include) a head or any desired portion of a head that, preferably, also includes a mouth or a portion of a mouth along with a portion of the head.

The simulated image of a mouth (or head) is not visible when the novelty shirt 1 is viewed from the front and the long sleeves 5,5' are not crossed in front of the chest. The complementary mouth patterns, as previously described, are disposed on each of the long sleeves 5,5'.

It can be seen that a first image portion is disposed on a first of the sleeves 5 and that a second image portion is disposed on a second of the sleeves 5' and that, when the arms of the wearer are crossed in front of the chest, the first image portion combines with said second image portion to produce a combined image. It is the combined image that makes sense to an onlooker and it is the combined image that forms the simulated image (of the mouth or head with mouth in combination).

Because the complementary mouth patterns generally correspond with a top of the mouth and a bottom of the mouth it is desirable that when the arms are crossed the top image portion of the mouth is disposed on top and the bottom image portion of the mouth is disposed on bottom.

This is accomplished by convention in design, as desired. In the example, the top portion of the image of the mouth is imprinted on the outside section 13 of the sleeve 5 of the right arm of the wearer. The bottom portion of the image of the mouth is imprinted on the outside section 13' of the sleeve 5' of the left arm of the wearer.

Knowing this, the wearer, when crossing his or her arms, disposes their right arm above their left arm when entering in the second position. This, thereby, ensures that the proper placement of the complementary mouth patterns is attained. It is also noted that the hands preferably reach around and are placed over the opposite shoulders. In other words the hand of the right arm is placed over the left shoulder and the hand of the left arm is placed over the right shoulder.

If desired this design convention could, of course, be reversed whereby the left arm could be disposed over the right arm by a corresponding change in the positioning of he complementary mouth patterns on the sleeves 5,5'.

It is noted that in FIG. 4 the elbows 11,11' are disposed adjacent to each other (in the second position). In this position the simulated image of a mouth appears to be closed. Referring now momentarily to FIG. 2 it is noted that the elbows 11, 11' are disposed in a slightly spaced-apart relationship with respect to each other. In this position the simulated image of the mouth appears to be open. When the hand of the right arm is placed over the left shoulder and the hand of the left arm is placed over the right shoulder and the elbows 11,11' are urged apart (i.e., when the mouth is open), this is regarded as the novelty shirt 1 being disposed in (i.e., urged into) a third position.

This ability adds greatly to the utility and enjoyment as provided by the novelty shirt 1. The wearer is able to open and close the simulated image of the mouth by urging the elbows 11, 11' apart and by urging them together, respectively.

The novelty shirt 1 encourages the wearer, at appropriate times, to enter initially into the second position generally and from the second position to further animate the novelty shirt 1 by opening and closing the simulated image of a mouth, that is by urging the elbows 11, 11' apart and together. This action (i.e., going from the second position into the third position and then back again into the second position) is repeated as many times as desired. The act of doing so is a form of play or recreation. It is also a way to exercise certain muscle groups that are not generally used in any significant degree by most people.

Accordingly, an unexpected benefit provided by the novelty shirt 1 is that it promotes and encourages exercise and that the exercise it promotes is generally perceived by the wearer of the novelty shirt 1 as a form of play.

The simulated opening and closing of the mouth, with certain image designs, can also appear to simulate speech. In this way, the novelty shirt 1 can be used by two or more people, each one wearing a version thereof, to appear to engage in mock conversation and appear as if they are talking with each other. This can be done silently when appropriate or, when desired, by the wearer speaking in an audible manner as the novelty shirt 1 is manipulated between the second and third positions. Accordingly, another form of possible interaction and play is provided.

Additionally, when the novelty shirt 1 is disposed in the second position the simulated image of the mouth appears to form out of nowhere and to do so quite suddenly. The sudden resultant change in appearance that is provided and thereby projected by the novelty shirt 1 in the second position is generally perceived as surprising to an observer (onlooker). This surprise encourages a response of some sort by the observer, typically that response being laughter or some comment. In this manner the novelty shirt 1 helps to engage the observer in a social interaction with the wearer. This, in turn, helps to increase the amount of attention that the wearer receives and it also fosters social interaction, including various forms of play that depend on the use of the novelty shirt 1.

It is also noted that additional image detail, for example lips and a tongue (reference numeral 31, FIG. 2) can be included as desired anywhere desired on either of the long sleeves 5,5'. The additional image detail provides for greater realism, especially when the simulated image of the mouth appears to be open. The additional image detail is included on any desired portion of the long sleeves 5,5'. The inclusion of additional image detail is described in greater detail hereinafter.

It is also important to note that the primary image appearing on the chest section 3 (i.e., the body and head of a frog in the example as shown) cooperates with the simulated image of the mouth whenever the novelty shirt 1 is disposed in the second position. Referring to FIG. 2, the body of the frog is disposed below the simulated image of the mouth that is produced by the long sleeves 5,5'.

Accordingly, the body of the frog (i.e., a remaining visible portion of the primary image) appears to flow naturally into the simulated image of the mouth that is produced when the novelty shirt 1 is in the second or third position. In this manner any primary image that is disposed on the chest section 3 of the novelty shirt 1 cooperates with the simulated image of the mouth (i.e., the combined image) to produce an alternate overall image whenever the novelty shirt 1 is disposed in the second position. In this manner, the appearance of the novelty shirt 1, when viewed from the front, is dramatically changed merely by an urging of the arms into or out of the second (or third) position.

Referring now also to FIGS. 5-6, 7-8, 9, and 10 it is noted that these figures illustrate other novelty shirts 1 employing the present invention of FIGS. 1-2. It is apparent that by inscribing a desired complementary image pattern on both of the long sleeves 5,5' an infinite variety of styles and appearances for the novelty shirt 1 are possible, both in the first position and also when the novelty shirt 1 is disposed in the second or third position.

Figure 6:
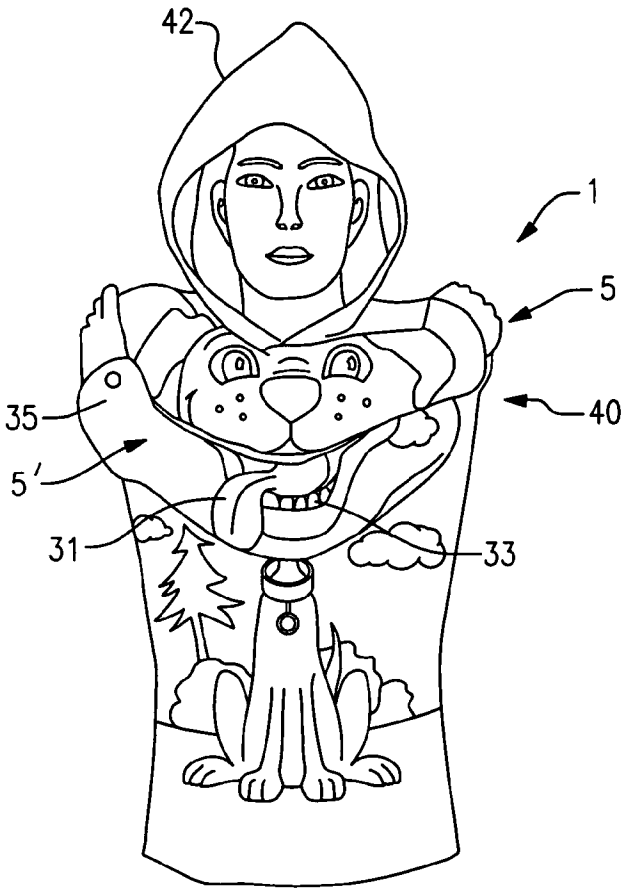
FIGS. 5 and 6 are views of a second embodiment of the shirt of the present invention.

FIG. 6 also illustrates how the primary image that is disposed on the chest section 3 of the novelty shirt 1, in this instance that of a dog's body, again cooperates with the newly formed simulated image of a mouth as provided by the novelty shirt 1 when it is disposed in the second position.

It is also important to note that the top section of any mouth for humans and most, if not all, animals or creatures is attached to an upper portion of the head. This means that the complementary mouth patterns as appearing on the long sleeves 5,5' will typically also include some additional image detail of at least a portion of the head of the animal (or whatever creature, real or fictitious, or other image is being displayed on or created by the novelty shirt 1).

For example, referring both to FIG. 2 and FIG. 6, it is noted that the right long sleeve 5 includes as additional image detail frog eyes and a top of the frog's head (for FIG. 2) and a dog's nose, eyes, ears, and a top of the dog's head (for FIG. 6). The top boundary of the dog's mouth is adequately defined by the contrast arising between an ending of the fur of the cheek or upper lip areas and a darker surrounding area that represents an interior of the dog's mouth.

For FIG. 6, the lower complementary mouth pattern as appearing on the left long sleeve 5' includes as additional image detail dog's teeth emanating from the dog's jawbone and a tongue that is draped over a portion of the teeth and apparently extending out of the dog's open mouth. Some of this additional image detail is, as previously described, more visible when the elbow portions 11,11' are slightly separated from each other, as when the novelty shirt 1 is in the third position or any intermediate position possible between the second and third positions.

Therefore, it is important to note that the complementary mouth patterns, when the novelty shirt 1 is disposed in the second position, also provide for an alternative head image, as shown in general by reference numeral 40. The alternate head image 40 includes the complementary mouth patterns as a part of the combined image.

When the novelty shirt 1 is disposed in the second position, the alternative head image 40 combines with the primary image that is disposed on the chest section 3 and thereby provides for the alternate overall image. The alternate overall image provides a contrasting appearance as compared with the primary image that is disposed on the chest section 3 of the novelty shirt 1. It is the sudden appearance of the contrasting alternate overall image that vivifies and thereby animates the novelty shirt 1.

For example, the alternate head image 40 may appear to face in a slightly different direction than does the primary image that is disposed on the chest section 3. The alternate head image 40 of the frog appears to be looking directly forward, whereas the original head image of the primary image that is disposed on the chest section 3 has the frog's head looking slightly off to one side. The alternate head image 40 of the frog also provides for a larger overall size for the head than that as imprinted on the primary image. Additionally, there is a notable change in the frog's expression between the primary image and that provided by the alternate head image 40.

Similarly, the primary image of the dog has its head facing toward the wearer's right side whereas the alternate head image 40 is forward facing and again, larger. These are all optional design parameters (i.e., view, size, expression) that are varied to suit with each particular version of the novelty shirt 1.

The change in direction of view, size, and expression of the alternate head image 40 that arises whenever the novelty shirt 1 is urged from the first position into the second position provides for a strong element of novelty and even surprise to onlookers. It can even startle an onlooker. In use, it appears as if the primary image has itself taken to life and noticed the presence of the onlooker. It is as if the alternate head image 40 is responding to the onlooker by turning and looking directly at the onlooker whenever the wearer crosses his arms to urge the novelty shirt 1 into the second position.

In this manner the novelty shirt 1 becomes a creative extension of the wearer that permits the wearer to dramatically express himself or herself to others in novel ways.

Figure 5:
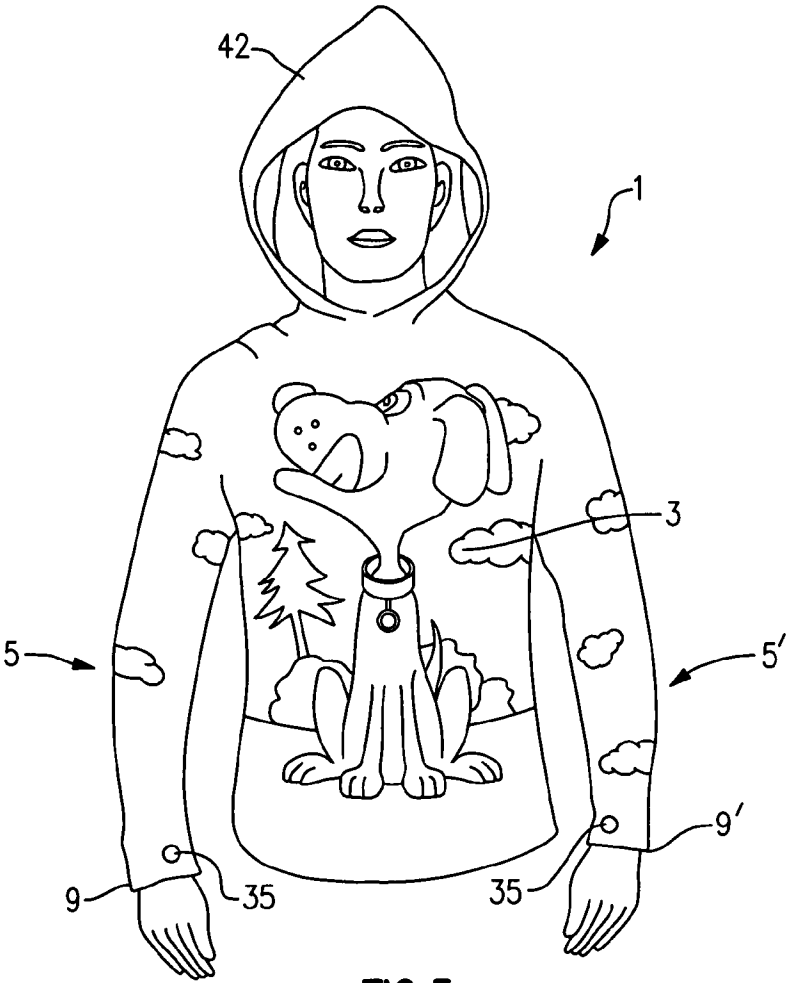
Figure 8:
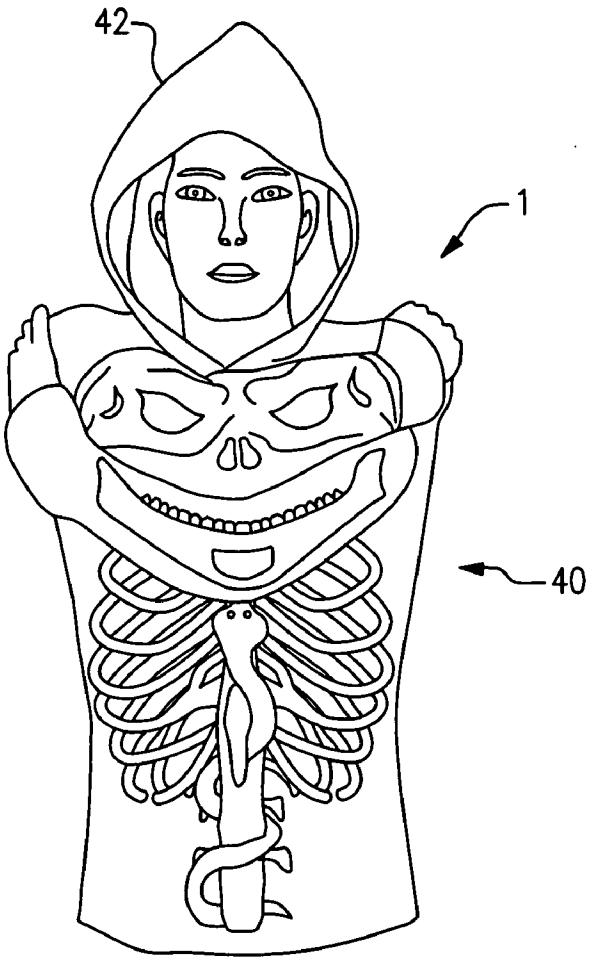
FIGS. 7-8 are views of another embodiment.

As shown in FIG. 5, the chest portion 3 includes a full body pattern (i.e., primary image) as in FIG. 1 wherein the crossed sleeves 5,5' as shown in FIG. 2 provide for a different face (FIG. 6) or facial expression to the full design (i.e., alternate overall image).

Figure 7:
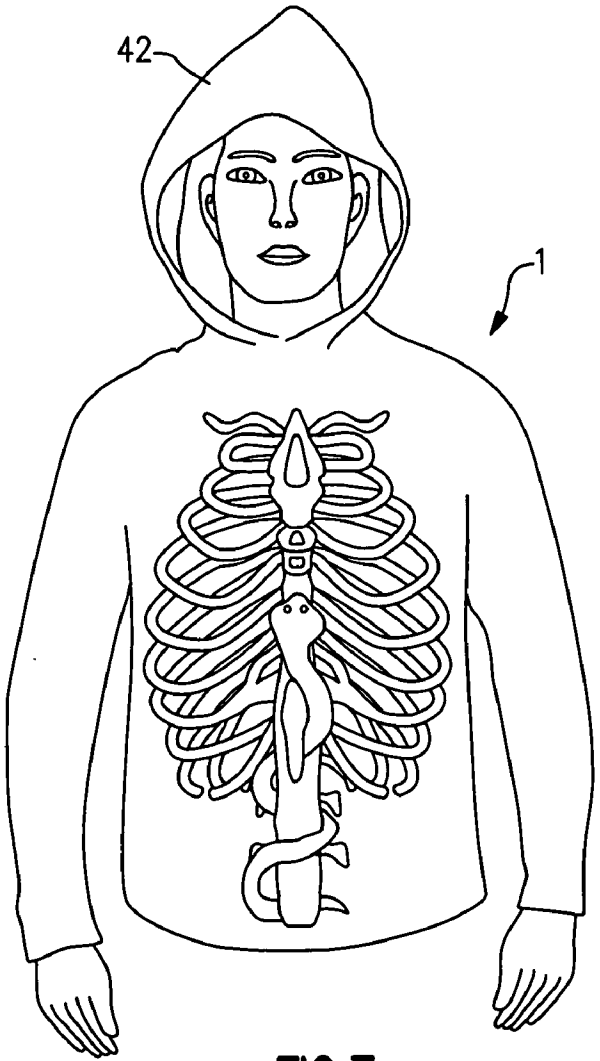

It is also possible to omit the head from the primary image that appears on the chest section 3, if desired. For example referring now to FIG. 7, the primary image on the chest section 3, as shown, includes an image depicting a separate body part or parts (e.g., the rib cage, spinal column, and some internal body parts in FIGS. 7-8) and is absent any representation of a head. However, when the novelty shirt 1 of FIG. 7 is disposed in the second position, the alternate head image 40 relates well with the primary image (that does not have a head). The alternate overall image, in this manner, completes the image and suddenly vivifies the novelty shirt 1 whenever it is urged into the second or third positions.

The head and mouth of the alternate head image 40, as shown, is skeletal in appearance and thereby aesthetically compliments the skeletal appearance of the primary image on the chest portion 3.

If preferred, the chest section 3 can additionally be plain (FIG. 9) and not include any particular image imprinted thereon. In this manner, the only caricature or image that is formed by the novelty shirt 1 is provided by the alternate head image 40 (i.e., whenever the novelty shirt 1 is in either the second or third position).

Figure 10:
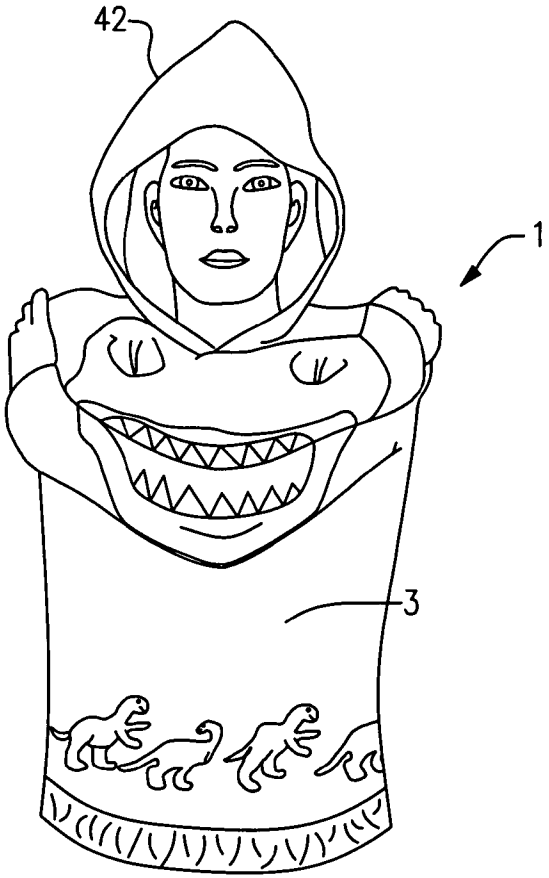
FIGS. 9-10 illustrate further embodiments.
Figure 9:
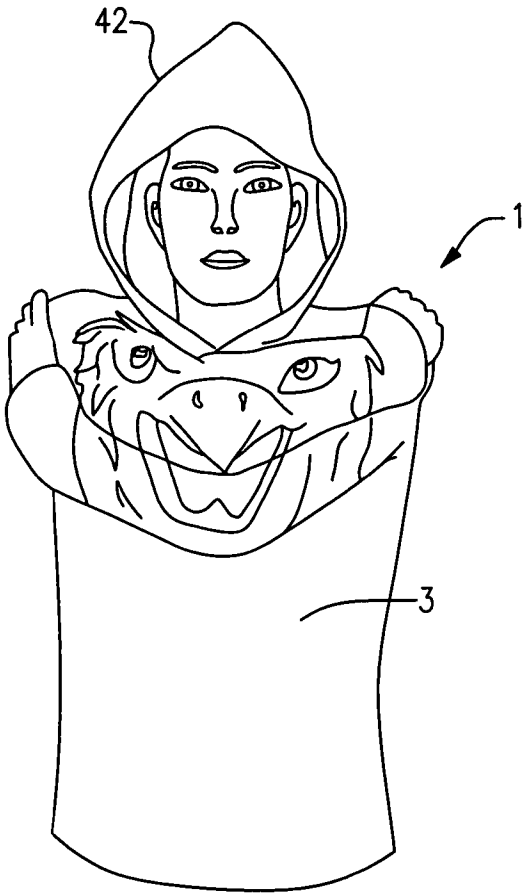

Referring now to FIG. 10, the chest section 3 may have a separate pattern that is not specifically tied into the mouth but which, nevertheless, works well with the mouth when the novelty shirt 1 is disposed in the second position.

The upper and lower mouth patterns can extend over all of the outside sections 13,13' (FIG. 3) between the vertically extending rearward 21,23 and forward 25,27 strips or locations on the sleeves 5,5'. The patterns can also extend over portions thereof, if desired, or overlap into the inside sections 15,15' as desired.

In the illustrated embodiments of FIGS. 1-2, 5-6, and 7-8, for example, the upper and lower mouth patterns extend about the vertical axes V (FIG. 3) substantially from the rearward locations 21,23 to about halfway around toward the forward locations 25,27. In these embodiments, virtually no upper or lower mouth pattern shows when the long sleeves 5,5' are in the positions of FIGS. 5 and 7 extending downwardly along the sides of the chest section 3. With many designs, the upper and lower lips of the mouth preferably start at or adjacent the rearward locations 21,23.

Figure 12:
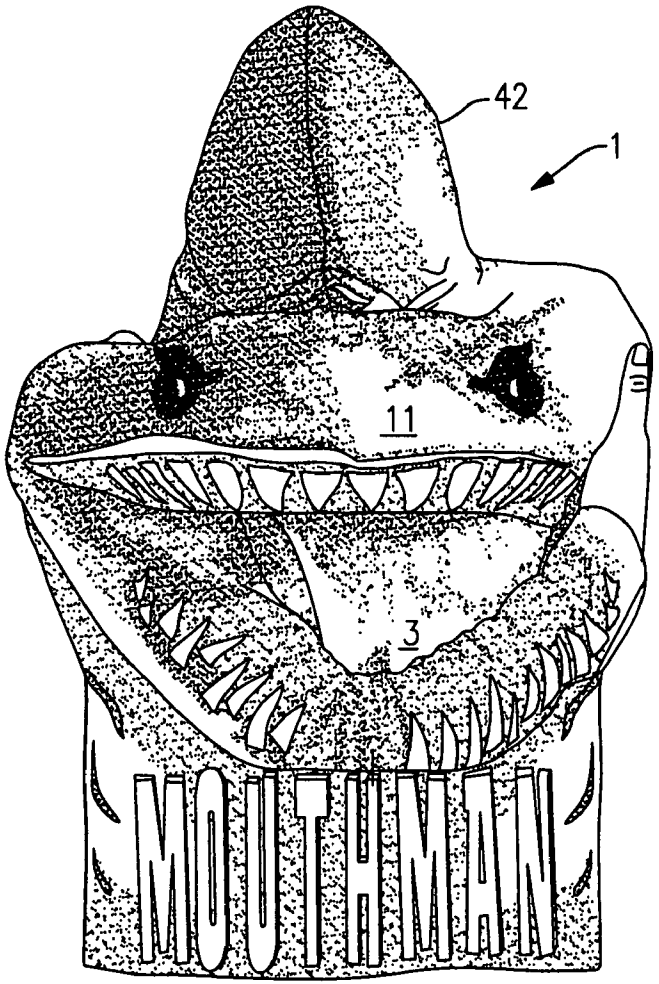
FIGS. 11 and 12 are side and front views, respectively, of an additional embodiment.
Figure 11:
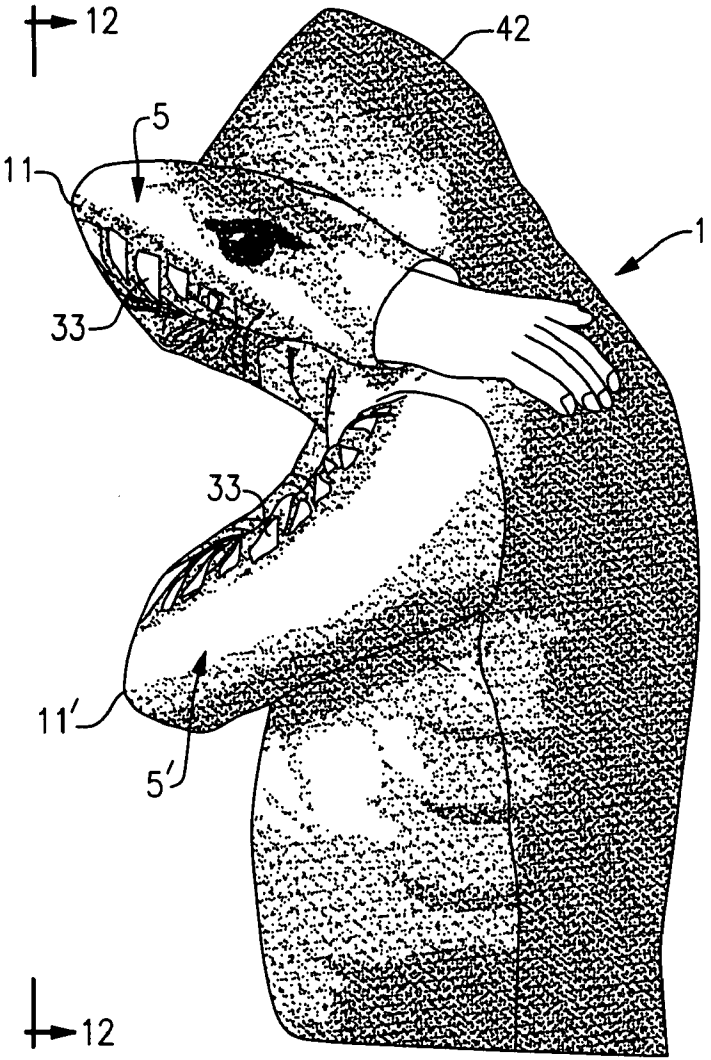

In a preferred manner of operation as was mentioned hereinbefore, the crossed sleeves 5,5' in the closed position of FIG. 2 with the elbow portions 11,11' substantially adjacent one another (FIG. 4) can be moved to a position such as in FIGS. 11 and 12. In this position of FIGS. 11 and 12, the elbow portions 11,11' are moved or spaced apart (e.g., vertically separated about a vertical axis) to simulate the mouth being open. The sleeves 5,5' can thereafter be repeatedly moved between these two positions (second and third positions) as desired to simulate the opening and closing of the mouth.

The patterns on the shirts 1 can further include mouth parts such as a tongue 31 (FIGS. 2 and 6) or teeth 33 (FIGS. 6 and 11) or any other additional detail as may be desired. All or portions of these mouth parts can be on the outside sections 13,13' of the sleeves 5,5' (FIGS. 2 and 6) and/or on the inside sections 15,15' of the sleeves 5,5' (FIGS. 11-13).

Figure 13:
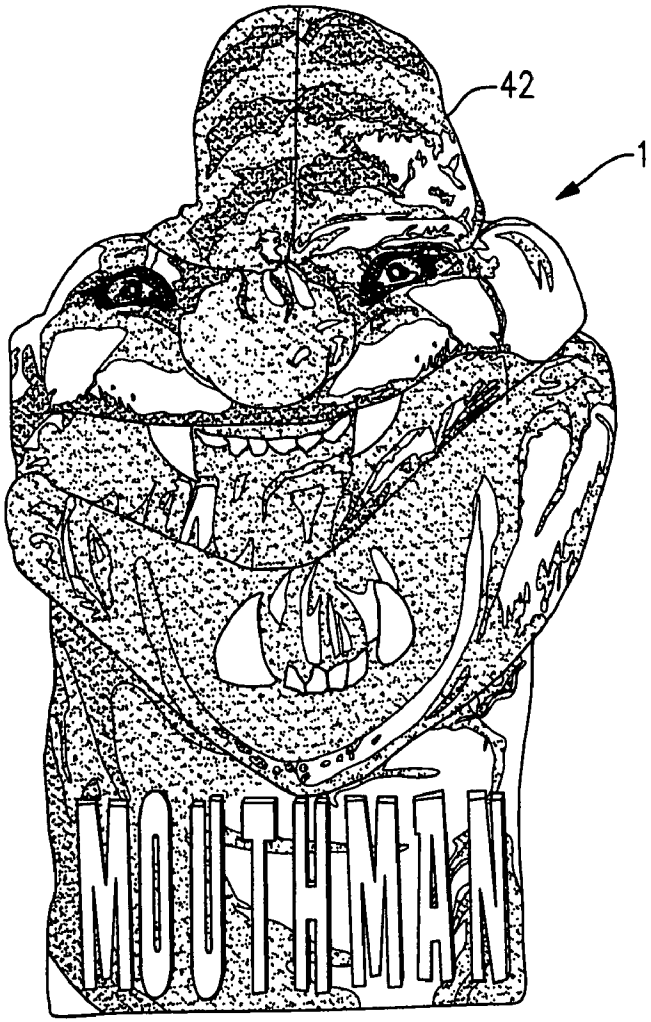
FIG. 13 is a view similar to FIG. 12 of another embodiment of the shirt of the present invention.

Additional patterns (e.g., throats or other image detail) can also be included on the primary image as imprinted on the chest sections 3, as shown in FIGS. 12 and 13. If desired, it is possible to more fully open the mouth (i.e., to maximally urge the elbow portions 11, 11' apart). In this maximally open position some of the primary image of the chest section 3 may become visible to an onlooker.

Bearing this in mind, the primary image on the chest section 3 can include an imprinted pattern that cooperates well and even augments the appearance of the alternate head image 40 when the mouth is maximally opened (i.e., elbows 11,11' maximally urged apart while in the second position, generally). The imprinted pattern may or may not form a discernible image on the chest section 3. However, when the mouth is maximally opened, the imprinted pattern on the chest section 3 helps to form the desired structures in the mouth, for example, tongue, throat, etc.

The various versions of the novelty shirt 1 with the sleeves 5,5' in the crossed position (e.g., FIG. 6) are preferably intended to have a taut appearance to best display the mouth. To aid in maintaining a taut appearance in the crossed position (e.g., FIG. 6), thumb holes 35 (FIGS. 5 and 6) can optionally be provided in the cuff portion areas 9,9' of the sleeves 5,5'. The wearer can then insert his or her thumbs in the holes 35, if desired. The sleeves 5,5' can also be fitted tightly to the wearer to help maintain a taut appearance, particularly if the lower or cuff portion areas 9,9' only extend to the wearer's forearms.

It is noted that although the present invention preferably has mouth patterns, it could have other design patterns (e.g., winking eye) and/or words that are only formed when the sleeves are disposed in the second position. If desired, words that are legible in the first position can, of course, also be included with the novelty shirt 1, as desired. Additionally, the elbow portions 11, 11' could be separated horizontally rather than vertically, if desired, to further animate the design pattern in additional various ways.

The patterns on the sleeves 5,5' could additionally be used to form multiple designs as, for example, when the sleeves 5,5' are aligned vertically and then horizontally or when the arrangement of the sleeves 5,5' is reversed (e.g., when the left sleeve 5' in FIG. 2 is placed above the right sleeve 5).

It is further noted that the article of apparel (i.e., the novelty shirt 1) has been described and illustrated as a long sleeve shirt but this term is intended to include any shirt-shaped item or garment (e.g., a shirt-shaped jacket, sweater, etc.) having a chest section and long sleeves.

It is also noted that a hood 42 is optionally included with the novelty shirt 1 and can add significantly to the appearance of the alternate overall image when the novelty shirt 1 is disposed in the second or third position.

The hood 42, in general, hides and thereby lessens the impact of the wearer's head upon the efficacy of the alternate overall image. Referring now to FIG. 11 and FIG. 12, it is noted that the wearer has the hood 42 disposed over their head and that they are tilting their heads forward while the novelty shirt 1 is disposed in the second position with the mouth maximally open. This tends to make the head of the wearer disappear from view to the onlooker who is looking directly at the novelty shirt 1 from the front. Instead, the hood 42 makes the head of the wearer appear as but an upper extension of the alternate head image 40, that is to say a continuation of the newly formed head image when the novelty shirt is in the second or third position.

Referring to FIG. 13, the hood 42 can also appear as a hat (i.e., resemble) that appears to be disposed on top of the alternate head image.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

What is claimed is:

1. A method of patterning and manipulating a shirt-shaped garment to selectively form a mouth, the shirt-shaped garment having a chest section and two long sleeves attached thereto, each long sleeve extending downwardly in a first position along a substantially vertical axis adjacent a side of the chest section and having a shoulder portion and a lower, cuff portion spaced therefrom along said vertical axis with an elbow portion therebetween, said method including the steps of:

(a) providing an upper mouth pattern on an outside section of one of the long sleeves, said upper mouth pattern extending along the vertical axis of said one long sleeve in said first position and facing substantially outwardly of the chest section, (b) providing a lower mouth pattern on an outside section of the second long sleeve, said lower mouth pattern extending along the vertical axis of said second long sleeve in said first position and facing substantially outwardly of the chest section, said lower mouth pattern on the second long sleeve being complementary to the upper mouth pattern on the one long sleeve, and (c) crossing the long sleeves laterally in front of the chest section in a second position with the long sleeves extending substantially side to side laterally across the chest section and with the cuff portion of each long sleeve adjacent the shoulder portion of the other long sleeve with the elbow sections substantially adjacent one another, and with the upper and lower complementary mouth patterns aligned to form a mouth.

2. The method of claim 1 further including the step of:

(d) moving said long sleeve from said second position with the elbow portions substantially adjacent one another to a third position with the elbow portions spaced apart from each other to simulate the mouth of the second position being open in said third position.

3. The method of claim 2 further including the limitation of moving the long sleeve repeatedly between said second and third positions.

4. The method of claim 2 further including the limitation of providing a pattern of an inner part of a mouth an at least a first of the two long sleeves, said inner mouth part extending along the vertical axis of the first long sleeve in said first position.

5. The method of claim 4 wherein said inner mouth part pattern includes a tongue.

6. The method of claim 4 wherein said inner mouth part pattern includes teeth.

7. The method of claim 4 wherein at least a portion of said inner mouth part pattern is on the outer section of the first long sleeve.

8. The method of claim 4 wherein at least a portion of said inner mouth part pattern is on an inside section of the first long sleeve.

9. The method of claim 2 further including the step of providing a pattern relating to said mouth on said chest section.

10. The method of claim 9 wherein said related pattern includes a throat.

11. The method of claim 1 further including the step of providing thumb holes in said long sleeves adjacent the cuff portions thereof.

* * * * *